US005366676A

United States Patent [19]

Kobayashi

[11] Patent Number: 5,366,676

[45] Date of Patent: Nov. 22, 1994

[54] METHOD AND APPARATUS FOR MANUFACTURING CONCRETE PANELS BY CONTINOUS PRESSING

[76] Inventor: Shigeru Kobayashi, 401-2, Karigane-cho, Ayakoji sagaru, Iwagamidori, Shimogyo-ku, Kyoto-shi, Kyoto, Japan

[21] Appl. No.: 80,695

[22] Filed: Jun. 22, 1993

Related U.S. Application Data

[63] Continuation of Ser. No. 855,594, Mar. 20, 1992, abandoned.

[30] Foreign Application Priority Data

Dec. 17, 1991 [JP] Japan ..... 3-333445

[51] Int. Cl.[5] ..... B28B 1/08; B28B 5/00; B28B 11/14

[52] U.S. Cl. ..... 264/70; 264/71; 264/150; 264/157; 264/163; 264/211.11; 264/297.7; 264/312; 264/333; 264/DIG. 31; 425/64; 425/220; 425/262; 425/308; 425/427; 425/432; 425/433; 425/434; 425/456

[58] Field of Search ..... 264/69–72, 264/148, 150, 151, 157, 160, 163, 177.11, 177.2, 211, 211.11, 297.7, 297.9, 312, 333, DIG. 31; 425/64, 218, 200, 262, 424, 426, 427, 430, 432, 433, 434, 456, 308

[56] References Cited

U.S. PATENT DOCUMENTS

| | | | |
|---|---|---|---|
| 3,002,249 | 10/1961 | Jackson | 264/71 X |
| 3,423,492 | 1/1969 | Jonell et al. | 264/70 |
| 3,608,003 | 9/1971 | Klaue et al. | 264/70 X |
| 3,877,860 | 4/1975 | Putti | 425/432 X |
| 3,892,826 | 7/1975 | Yost | 264/72 |
| 4,133,619 | 1/1979 | Wise | 425/432 X |
| 4,574,064 | 3/1986 | Paakkinen | 264/70 |
| 4,608,216 | 8/1986 | Barsk | 264/72 X |
| 4,655,981 | 4/1987 | Nielsen et al. | 264/148 X |
| 4,666,648 | 5/1987 | Brittain | 264/157 X |
| 4,708,628 | 11/1987 | Mkhikian et al. | 425/432 X |
| 4,718,838 | 1/1988 | Ren et al. | 425/432 X |
| 4,773,838 | 9/1988 | Seppanen | 425/432 X |
| 4,856,395 | 8/1989 | Smith et al. | 264/157 X |
| 5,017,320 | 5/1991 | Velazquez Garcia | 264/148 |
| 5,023,030 | 6/1991 | Rantanen | 264/70 X |
| 5,076,985 | 12/1991 | Koch et al. | 264/160 X |

FOREIGN PATENT DOCUMENTS

| | | | |
|---|---|---|---|
| 175930 | 4/1986 | European Pat. Off. | 264/71 |
| 192884 | 9/1986 | European Pat. Off. | 264/71 |
| 1577321 | 10/1980 | United Kingdom | 264/333 |
| 148342 | 12/1962 | U.S.S.R. | 264/70 |
| 504652 | 5/1976 | U.S.S.R. | 264/70 |
| 727452 | 4/1980 | U.S.S.R. | 264/70 |
| 1004096 | 3/1983 | U.S.S.R. | 264/72 |
| 1212802 | 2/1986 | U.S.S.R. | 264/70 |
| 1379114 | 3/1988 | U.S.S.R. | 264/71 |
| 04362 | 10/1985 | WIPO . | |

*Primary Examiner*—Karen Aftergut
*Attorney, Agent, or Firm*—Flynn, Thiel, Boutell & Tanis

[57] ABSTRACT

A method for manufacturing concrete panels by continuously pressing and an apparatus for carrying out the method. The concrete panels are successively manufactured by continuously feeding pallets onto a conveyor, feeding a concrete material onto the pallets, continuously pressure frames against the concrete material from the upper side and both lateral sides of the concrete material while imparting vibrations to the pressure frames, forming hollows in the concrete material by thrusting a rotary screw-type core rod therethrough to provide a panel shape hollow molding, and cutting the molded concrete material into a length corresponding to the length of each pallet. In the manufacture process, an organic or inorganic fiber material may be incorporated into the concrete material for the purpose of reinforcement of the finished products.

3 Claims, 4 Drawing Sheets

METHOD AND APPARATUS FOR MANUFACTURING CONCRETE PANELS BY CONTINOUS PRESSING

This application is a continuation of U.S. application Ser. No. 07/855,594, filed Mar. 20, 1992, now abandoned.

BACKGROUND OF THE INVENTION

1. Field of the Invention

The present invention relates to a method for manufacturing long size concrete panels having penetrating hollows therein and an apparatus for putting the method into practice.

2. Description of the Prior Art

In the manufacturing of long size panels, there have heretofore been known the following methods, namely;

1) a method comprising feeding a soft kneaded concrete material into a molding box, imparting vibrations to the concrete material to compact into moldings and setting the moldings; and 2) a method comprising feeding a fairly hard kneaded concrete material into a molding box by a concrete material feeding device moving on a long floor, imparting vibrations to the concrete material from above to compact it wherein hollows are formed in the compacted concrete material by thrusting into the concrete material a core member which is adapted to be moved by a strained guide wire in accordance with the movement of the concrete material feeding device; curing and setting the concrete material; and cutting the concrete material into desired sizes.

In order to produce long size concrete panels as set forth above, a very wide floor area is required for laying concrete molding materials side by side on the same floor and performing molding and drying operations. Further, it is difficult to continuously feed concrete materials and continuously mold on the same site because of difficulties in controlling the processing conditions. Further, a large crane is needed to carry away the molded articles after drying from the above-mentioned wide concrete-manufacturing site. Such a manufacturing plant requires large capital investments. Accordingly, there has been a demand for establishment of a highly efficient continuous manufacturing process of long size concrete panels.

SUMMARY OF THE INVENTION

The present invention provides a method for manufacturing concrete panels by continuously pressing, the method comprising the steps of:

continuously feeding pallets onto a conveyor;

feeding a concrete material onto the pallets;

continuously pressing pressure frames against the concrete material from the upper side and both lateral sides of the concrete material while imparting vibrations to the pressure frames;

forming hollows in the concrete material by thrusting a rotary screw-type core rod therethrough and molding the material into a panel shape; and cutting the molded concrete material into a length corresponding to the length of each pallet.

Another aspect of the present invention is directed to an apparatus for putting the continuous manufacturing method into practice, the apparatus comprising:

concrete material feeding means for continuously feeding a concrete material onto pallets which are continuously conveyed by a conveyor;

pressure frames for vibrating and pressing the concrete material from the upper side and both lateral sides thereof;

a rotary screw-type core rod for forming hollows in the concrete material being vibrated and pressed; and cutting means shifting in accordance with the movement of the conveyor to cut the molded concrete material into the same length as the length of each of the pallets.

In the present invention, when an organic or inorganic fiber material is incorporated into the concrete material, the resulting molded products are reinforced.

In order to successively produce molded long size concrete panels according to the present invention, a concrete material is successively molded into a panel shape by being continuously vibrated and pressed in a stationary molding machine and cut into an appropriate length corresponding to the length of each pallet. The cut concrete panels are transported into a curing and setting room for curing. Such a new manufacturing method makes a wide manufacturing floor space unnecessary and makes it possible to perform the molding operations in the same site. Therefore, quality control of the products becomes easy.

DETAILED DESCRIPTION OF THE PREFERRED EMBODIMENTS

An embodiment of the present invention will be described hereinbelow with reference to the accompanying drawings.

Figure 1:
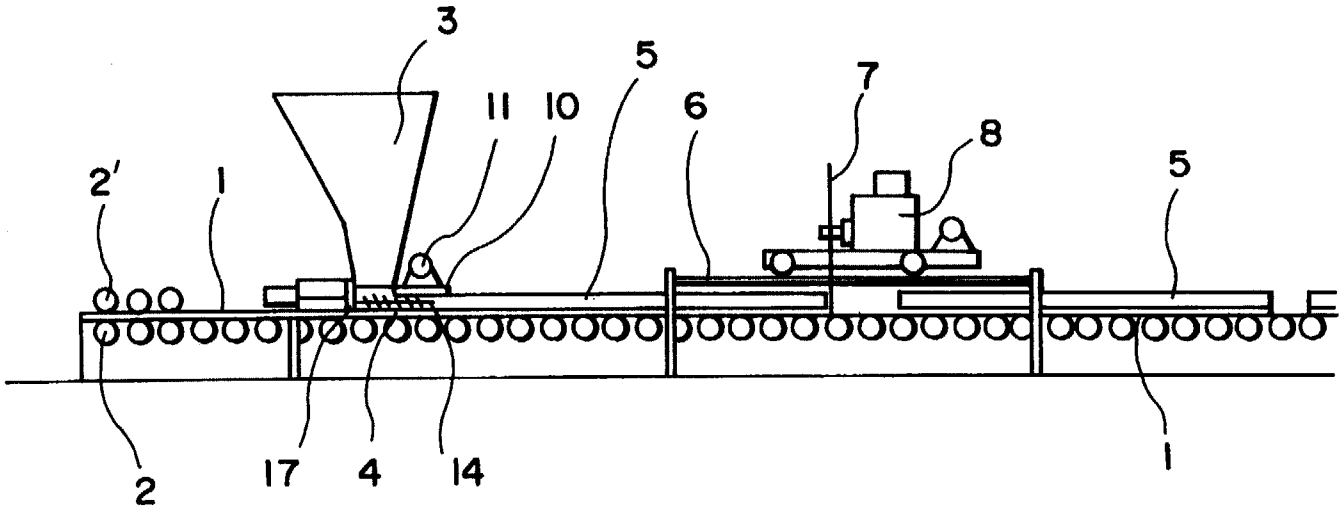
FIG. 1 is a schematic front view of an apparatus for carrying out the present invention.
Figure 2:
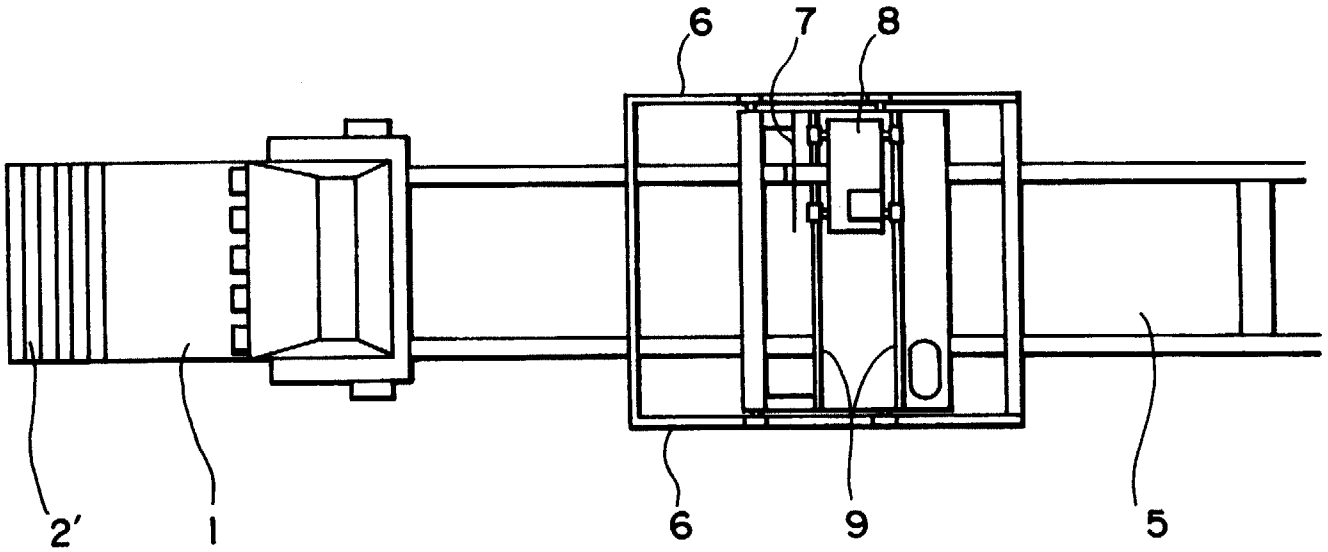
FIG. 2 is a plan view of FIG. 1.

FIG. 1 is a front elevational view of an apparatus for putting the present invention into practice and FIG. 2 is a plan view thereof. Pallets 1 having a given length are continuously fed at a predetermined rate onto roller conveyors 2 and 2'. Reference numeral 3 represents hopper-like concrete material feeding means for feeding a concrete material into a molding section 4. The molding section 4 is described hereinafter in detail. The concrete material is molded by vibrating and pressing at the molding section. The molded concrete material 5 is forwarded and cut into a length corresponding to the length of each pallet 1 by a rotary cutter 7 which is carried by a holder member 8. The holder member 8 is shiftable along guide rails 9 at a right angle to guide rails 6 while simultaneously shifting along the guide rails 6 at a speed corresponding to the speed of the conveyor 2. The products are transported together with the pallets 1 into a curing area (not shown) and, then, cured for a certain period of time. The resultant cured products are delivered as finished products.

Figure 3:
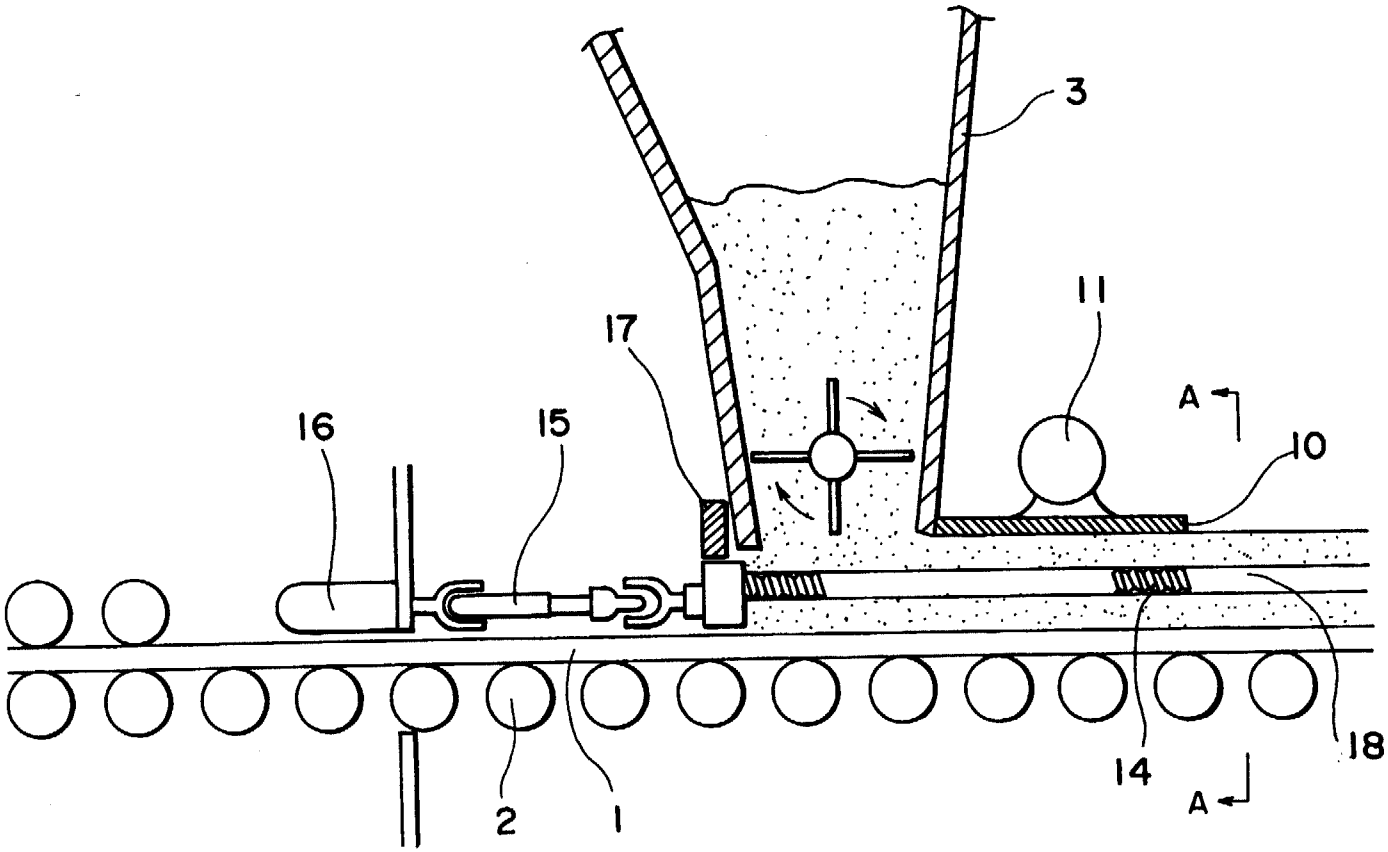
FIG. 3 is an explanation diagram showing a main structural part of a molding section.
Figure 4:
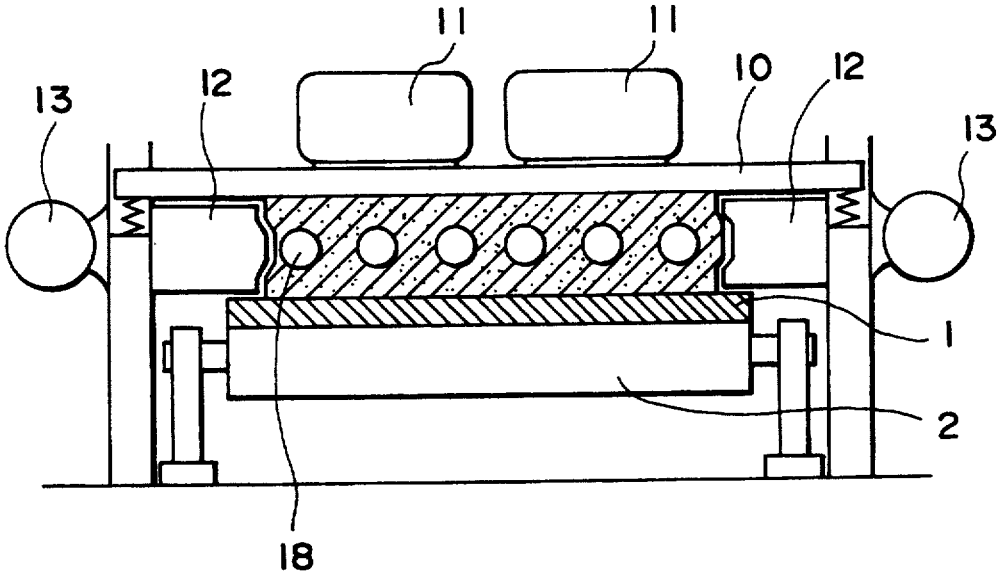
FIG. 4 is a cross-sectional view of a portion taken along the line A—A in FIG. 3.

FIG. 3 is an explanation diagram of a main structural part of the molding section 4 and FIG. 4 is a cross-sectional view thereof taken along the line A—A. Reference numeral 10 represents an upper pressure frame and reference numerals 12 and 12 represent lateral pressure frames. These pressure frames are vibrated and compressed by vibrators 11 and 13. The upper pressure frame 10 and both lateral pressure frames 12 and 12 define a panel-like molding form on the pallet 1. Reference numeral 14 represents a rotary screw-type core rod and the core rod 14 is arranged so as to insert through a partition plate 17 into the molding form. The core rod 14 is rotated by a driving motor 16 connected to a flexible drive shaft 15 so that hollows 18 are formed in the panels. Since the exterior face of the rotary screw-type core rod 14 is formed in a spiral configuration, contact between the core rod 14 and the concrete material to be hollowed is lessened and hollows having the same diameter as the outer diameter of the spiral part of the core rod 14 can be easily formed.

Figure 5:
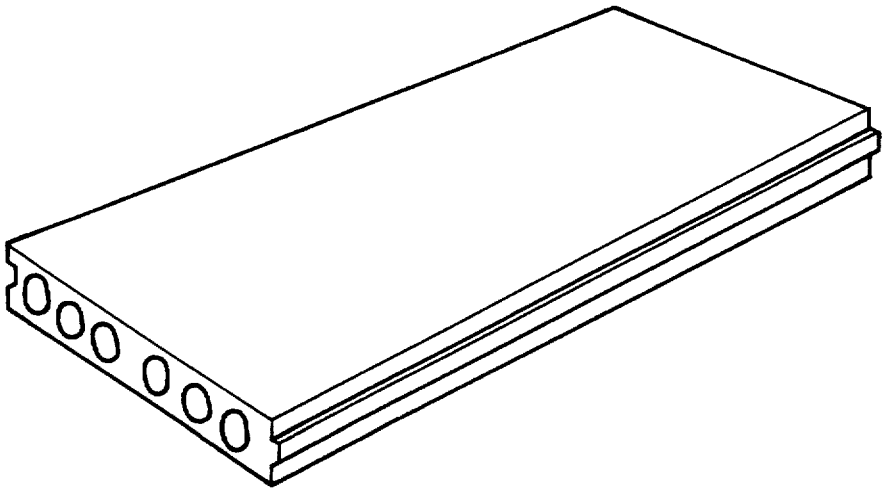
FIG. 5 is a perspective illustration of a finished product.

FIG. 5 shows a perspective view of the finished concrete product separated from the pallet 1 after curing.

Since a great number of long size concrete panels can be continuously molded in the continuous manufacturing line according to the present invention, the present invention is advantageous, especially with regard to processing operations, quality control, labor reduction, productivity, over conventional processes. Further, in comparison with conventional processes, the present invention substantially reduces the plant cost and makes a wide plant floor space unnecessary. Since the curing operation can be successively performed in the same site, a considerable energy-saving can be achieved. Further, since mass production can be safely performed without risk of industrial accidents, the production cost is significantly reduced.

What is claimed is:

1. A method for manufacturing concrete panels by continuously pressing, the method comprising the steps of:

continuously feeding pallets onto a moving roller conveyor;

feeding a concrete material onto the pallets;

continuously pressing pressure frames against the concrete material from an upper side and both lateral sides of the concrete material while vibrations are imparted to the pressure frames;

forming hollows in the concrete material by thrusting a rotary screw core rod therethrough and molding the material into a panel shape; and cutting the molded concrete material into a predetermined length corresponding to a length of each pallet in synchronism with the moving roller conveyor to manufacture concrete panels of predetermined length.

2. A method as claimed in claim 1 in which an organic or inorganic fiber material is incorporated into the concrete material.

3. An apparatus for manufacturing concrete panels by continuously pressing, the apparatus comprising:

concrete material feeding means for continuously feeding a concrete material onto pallets which are continuously conveyed by a roller conveyor, each of said pallets having a defined length;

pressure frames for vibrating and pressing the concrete material from an upper side and both lateral sides thereof;

a rotary screw core rod for forming hollows in the concrete material being vibrated and pressed; and cutting means shifting in accordance with movement of the roller conveyor to cut the concrete material when molded into a length equal to the length of each of the pallets to manufacture concrete panels of a predetermined length.

* * * * *

UNITED STATES PATENT AND TRADEMARK OFFICE

CERTIFICATE OF CORRECTION

PATENT NO. : 5,366,676
DATED : November 22, 1994
INVENTOR(S) : Shigeru Kobayashi It is certified that error appears in the above-indentified patent and that said Letters Patent is hereby corrected as shown below:

On the title page, item [54] and Column 1, line 3, change "continous" to --continuous --.

Signed and Sealed this

Fourteenth Day of March, 1995

Bruce Lehman

*Attest:*

BRUCE LEHMAN

*Attesting Officer*

*Commissioner of Patents and Trademarks*